US005239764A

United States Patent [19]

Seaton

[11] Patent Number: 5,239,764

[45] Date of Patent: Aug. 31, 1993

[54] SALES TAG FOR A GARDENING IMPLEMENT

[75] Inventor: Robert A. Seaton, Madison, Wis.

[73] Assignee: Fiskars Oy Ab, Helsinki, Finland

[21] Appl. No.: 889,947

[22] Filed: Jun. 2, 1992

[51] Int. Cl.[5] ..... G09F 3/10

[52] U.S. Cl. ..... 40/299; 40/665

[58] Field of Search ..... 40/299, 317, 331, 665, 40/539, 617, 310, 322; 211/113, 118

[56] References Cited

U.S. PATENT DOCUMENTS

| | | | |
|---|---|---|---|
| 2,324,093 | 7/1943 | Lhamon | 40/322 X |
| 3,398,867 | 8/1968 | Taylor et al. | 211/113 X |
| 3,423,861 | 1/1969 | Forsyth | 40/310 X |
| 3,831,300 | 8/1974 | Berkhouse | 40/310 |

FOREIGN PATENT DOCUMENTS

| | | | |
|---|---|---|---|
| 411556 | 6/1934 | United Kingdom | 40/665 |

*Primary Examiner*—Kenneth J. Dorner
*Assistant Examiner*—Brian K. Green
*Attorney, Agent, or Firm*—Foley & Lardner

[57] ABSTRACT

A sales tag for a garden implement having a handle connected to a tool by a gooseneck, the tag including a planar member having a fold line for defining a first and second section, the first section including an opening which is expandable for sliding the tag over the handle onto the gooseneck and the second section having an opening or slot defining a pair of tabs for engaging the tool to stabilize the tag on the top of the implement.

3 Claims, 2 Drawing Sheets

SALES TAG FOR A GARDENING IMPLEMENT

FIELD OF THE INVENTION

The present invention relates to a sales tag for a gardening implement, and more particularly, to a sales tag which is mounted on the implement and affixed thereto in a position to be readily observed by the buyer.

BACKGROUND OF THE INVENTION

Gardening tools of the type contemplated herein are generally mounted or suspended on a hook for display. Sales tags are loosely attached to gardening implements either by a string or loosely mounted on some part of the tool. Tags which are loosely secured to the implement cannot be readily observed by the prospective buyer because they are free to turn or hang in a position where the sales information cannot be seen. This requires the buyer to manipulate the tag in order to read the information on the tag.

Tags which are provided with an adhesive are permanently secured to the tool in a position to be observed by the buyer. However, they require special handling, additional expense to manufacture and are difficult to remove from the item once it has been purchased.

SUMMARY OF THE PRESENT INVENTION

The sales tag according to the present invention is adapted to be mounted on a gardening implement having a handle offset from a cultivating tool by a narrow gooseneck. The sales tag includes a planar member which is divided by a fold transverse to the elongate axis of the planar member to define a first section and a second section. Each section includes a front planar surface and a back planar surface. The front planar surface of the first section includes an elongate opening having a width smaller than the handle of the tool on which the tag is to be mounted and larger than the neck of the tool. The tag is provided with slits on each side of the opening to allow for expansion of the opening to allow the tag to pass over the handle onto the neck of the tool. The second section includes an opening transverse to the longitudinal axis of the planar member and a slot in the second section on the edge of the opening to define a pair of tabs. The second section being folded to allow the tabs to be affixed to the cultivating tool, whereby the sales tag is held in a fixed position on the tool in a position to be readily observed by the buyer.

The front planar surface of the first section advantageously provides a space on which the description of the implement can be printed. The back planar surface provides a space for the item identification indicia for the tool which can be quickly and easily scanned by the sales person.

Other principal features and advantages of the invention will become apparent to those skilled in the art upon review of the following drawings, the detailed description and the appended claims.

Figure 1:
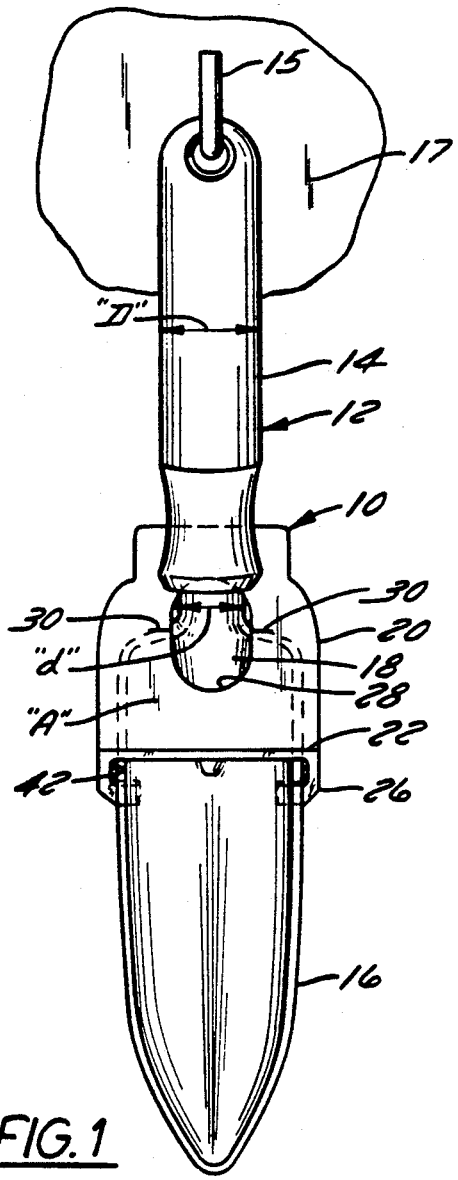
FIG. 1 is a top view of a gardening implement in the form of a trowel having the sales tag according to the present invention mounted on the top of the trowel.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 3:
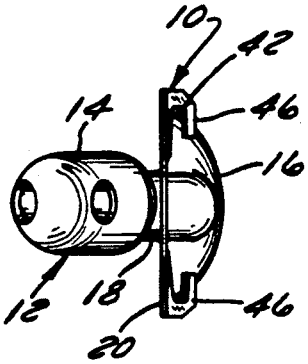
FIG. 3 is an end view of the sales tag.
Figure 2:
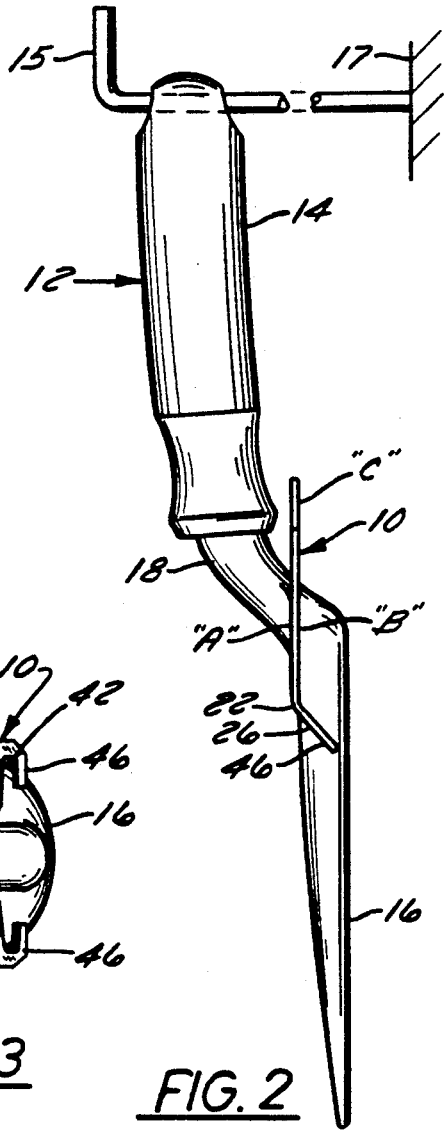
FIG. 2 is a side view of the trowel showing the tag mounted thereon.
Figure 4:
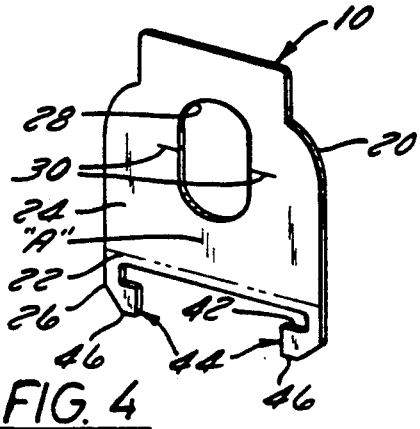
FIG. 4 is a perspective view of the front of the sales tag.
Figure 5:
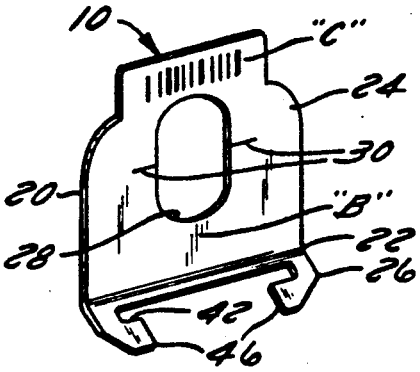
FIG. 5 is a perspective view of the back of the sales tag.

The sales tag 10 according to the present invention as shown in FIGS. 1 through 5, is adapted to be mounted on a garden implement 12 in a position to be readily observed by the buyer when mounted on a hook 15 on a stand 17. The gardening implement 12 generally includes a handle 14 which is offset from a trowel 16 by a gooseneck 18. It should be noted that the gooseneck 18 offsets the handle 14 from the plane of the trowel 16. It should be noted that the diameter "D" of the handle 14 is greater than the diameter "d" of the gooseneck.

In accordance with the invention, the sales tag 10 is formed from a planar member 20 having a fold line 22 provided transverse to the longitudinal axis of the planar member to form a first section 24 and a second section 26. Each section including a front planar surface "A" and a back planar surface "B." The first section 24 is provided with an elongate opening 28 having a width greater than the diameter "d" of the gooseneck 18 and smaller than the diameter "D" of the handle 14. The width of the opening 28 is enlarged by means of slits 30 provided in the first section 24 on each side of the opening 28. The handle 14 can be inserted into the opening 28 in alignment with the slits 34 which allow the handle to be pushed through the opening 28 without damaging the first section 20 of the tag 10. The opening 28 once aligned with the gooseneck 18 allows the first section 20 to lie flat against the top of the trowel 16.

The second section 26 is provided with means for securing the sales tag 10 to the trowel 16. Such means is in the form of an opening 42 in the second section 26 which is transverse to the elongate axis of the tag. A slot 44 is provided in the end of the section 26 which forms tabs 46 on each side of the slot 44. The second section 26 is folded downward for engagement with the trowel. In this regard, it should be noted that the tabs 46 overlap the edges of the trowel so that the tool is centered in the opening 42 in the second section. With this arrangement the tabs 46 secure the tag 10 to the top of the tool.

The front planar surface "A" provides a space for identifying the implement and its use. The back planar surface "B" provides a space for the identifying indicia "C" which can be readily scanned by the sales person when presented for purchase by the customer.

Figure 6:
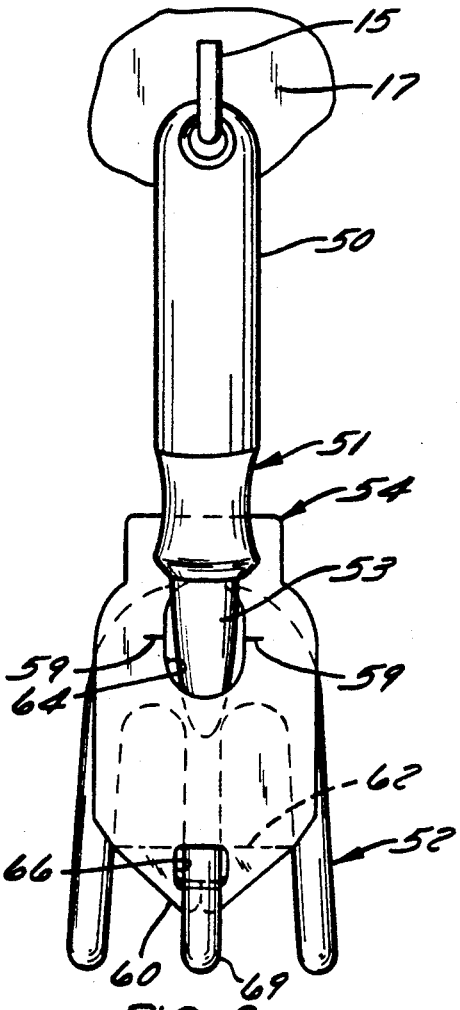
FIG. 6 is a top view of a gardening instrument in the form of a fork having the sales tag according to the invention mounted on the top of the fork.
Figure 7:
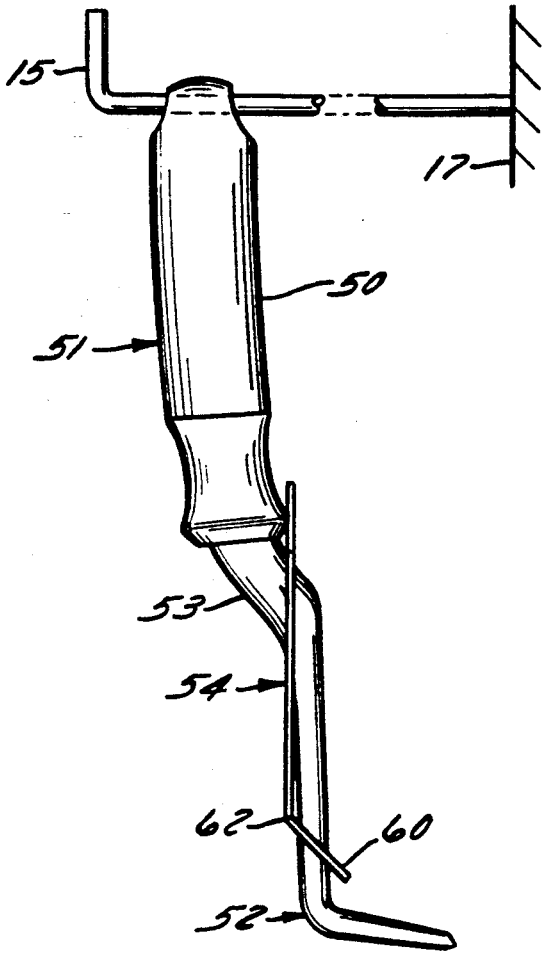
FIG. 7 is a side view of the fork showing the sales tag mounted thereon.
Figure 8:
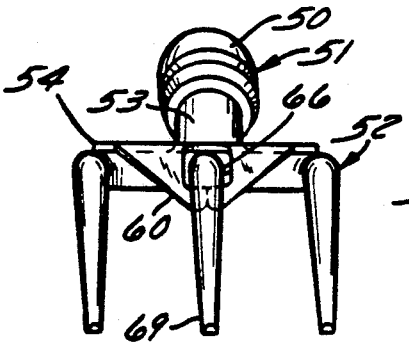
FIG. 8 is a front view of the fork with the tag mounted thereon.
Figure 9:
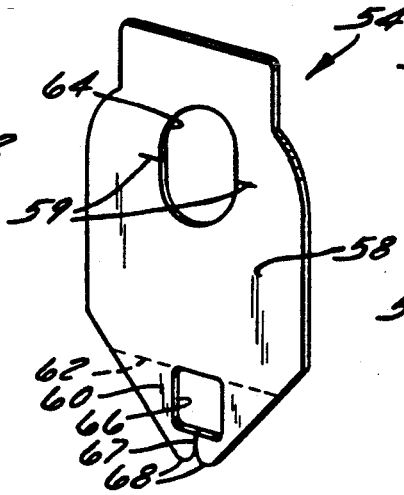
FIG. 9 is a perspective view of the front of the tag.
Figure 10:
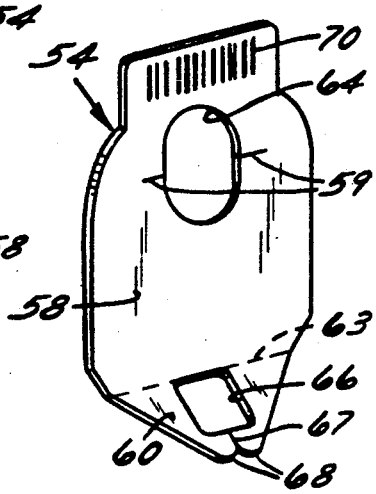
FIG. 10 is a perspective view of the back of the tag.

Referring to FIGS. 6 through 10, a gardening implement 51 is shown which includes a handle 50 offset from a three tyne fork 52 by a gooseneck 53. A sales tag 54 is mounted on the implement 51 in a position to be readily observed by the buyer as described above.

The tag 54 includes a first section 58 and a second section 60 which are separated by a fold line 62. An oblong opening 64 is provided in the first section 58 which has slits 59 on each side for mounting the tag on the gooseneck 53 and an opening 66 is provided in the second section 60. The lower edge 67 of the second section 60 is split at 67 to form tabs 68 which are seated on the center tyne 69 of the fork 52 to secure the tag 54 to the top of the fork.

It should be noted that advertising material such as the type of implement and its characteristics is provided on the front of the first section 58. An information indicia 70 is provided on the back of the first section 58 which can be readily scanned by the sales person when presented for purchase by the customer.

Thus, it should be apparent that there has been provided in accordance with the present invention a sales tag for a gardening tool that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A combination of a gardening implement having a handle and a cultivating tool offset from the handle by a gooseneck and a sales tag for identifying the gardening implement, said tag comprising a planar member having a longitudinal axis and a fold line transverse to said axis defining a first section and a second section, said first section having an oblong opening extending in a parallel relation to the longitudinal axis of the planar member and two slits in said first section transverse to the longitudinal axis of the opening to allow the tag to be mounted on the gooseneck of the implement, said second section including means for engaging the tool to secure the sales tag to the implement.

2. A tag according to claim 1 wherein said engaging means comprises an opening in said second section transverse to the longitudinal axis of the planar member and a slot in the second section forming a tab on each end of the opening for engaging the tool.

3. A tag according to claim 2 wherein said first section includes a front forming a space for advertising the tool and a back forming a space for information indicia.

* * * * *